United States Patent [19]

Arimatsu et al.

[11] 4,288,517

[45] Sep. 8, 1981

[54] TONER FOR ELECTROSTATIC PHOTOGRAPHY CONTAINING RESIN COATED SILICA PARTICLES

[75] Inventors: Seiji Arimatsu; Katsukiyo Ishikawa; Yasusi Umeda; Koichi Nagata, all of Neyagawa, Japan

[73] Assignee: Nippon Paint Co., Ltd., Japan

[21] Appl. No.: 149,834

[22] Filed: May 14, 1980

[30] Foreign Application Priority Data

Sep. 21, 1979 [JP] Japan ..... 54/122385

[51] Int. Cl.[3] ..... G03G 9/10

[52] U.S. Cl. ..... 430/110; 430/904; 430/99

[58] Field of Search ..... 430/107, 110, 904, 99; 427/221

[56] References Cited

U.S. PATENT DOCUMENTS 3,720,617 3/1973 Chatterji et al. ..... 430/110

3,983,045 9/1976 Jugle et al. ..... 430/110

FOREIGN PATENT DOCUMENTS 1522667 12/1966 Fed. Rep. of Germany ..... 430/111

*Primary Examiner*—John D. Welsh

*Attorney, Agent, or Firm*—Wenderoth, Lind & Ponack

[57] ABSTRACT

A toner composition for electrostatic photography which comprises (A) toner powder comprising a base resin and a coloring agent and having an average particle size of not more than 30 microns and (B) silica powder coated on its surface with the base resin of the toner powder.

8 Claims, No Drawings

TONER FOR ELECTROSTATIC PHOTOGRAPHY CONTAINING RESIN COATED SILICA PARTICLES

The present invention relates to a toner for electrostatic photography.

Formation of an image on the surface of a photoelectric conductor and development thereof by an electrostatic means have been widely accepted from many years ago. Procedures for development of such electrostatic image are roughly classified into the following two methods: (1) a liquid development method using a developing agent comprising an insulating organic medium and one or more kinds of coloring agents finely dispersed therein; and (2) a dry development method using a developing agent in fine powder (called "toner") comprising a natural or synthetic resin and a coloring agent (e.g. carbon black, a dye) dispersed therein. Among the latter, there are known cascade method, hair brush method, magnetic brush method, impression method, powder cloud method, etc. This invention pertains to a toner being employable in the dry development method.

In the dry development method, a two-component development procedure such as the cascade method or the magnetic brush method is widely adopted as a practical, valuable development method. For such two-component procedure, a mixture of an insulating toner having an average particle size of 30 microns or less and a granular substance usually called "carrier" is employed. In the cascade method, an insulating bead-like granular substance is used as the carrier. The toner is charged with electricity by friction with the carrier, adheres to the surface of the carrier and is thus transported to the development position. In the magnetic brush method, the carrier to be used is a magnetic granular substance (mainly iron particles) having an average particle size of about 70 to 100 microns. The carrier is attracted magnetically to a sleeve to make a shape of brush. The toner is charged with electricity by friction with the carrier as in the cascade method, adheres to the surface of the carrier and is thus transported to the development position. In development, the electroconductive carrier acts also as a developing electrode being extremely close to the surface of the photoelectric conductor.

The two-component development procedure has some problems both in the carrier and the toner. As to the carrier, it participates in the electrification and the transportation of the toner and functions as a development electrode (in case of the magnetic brush method), but it is not concerned directly with the development itself. Thus, it is not consumed every time of copying, so that its deterioration progresses with increase of the number of times of copying. The toner undergoes mechanical wear and tear due to the shearing force and the impact force during operations in the developing apparatus, and deterioration occurs after several thousand times of development operations. For prevention of such deterioration of the carrier, coating with various kinds of substances has been proposed to afford a certain effect of delaying of the deterioration rate, but the effect is restricted due to the necessity of maintaining the quality of developed picture.

In case of the toner, there have been also proposed various methods for prevention of deterioration, for example, the use of high molecular weight resins durable against mechanical wear and tear, the incorporation of wear-reducing agents (e.g. molybdenum disulfide) into the toner composition or the addition of silica powder into the toner powder to increase the powder fluidity produces a wear-reducing effect and the incorporation of silica powder into the toner composition imparts thereto a polishing effect on the toner components adhered to the carrier and the photoelectric conductor. However, these proposals cause other problems such as elevation of the fixing temperature, pollution of the carrier and the photoelectric conductor, confusion of the picture caused during the remixing of the recovered toner, wear and tear of the developing machine, reduction of the miscibility between the carrier and the toner, etc.

The main object of the present invention is to solve such problems as mentioned above and to provide a toner for electrostatic photography having superior characteristics in comparison with conventional toners, particularly a toner which is stable in powder and electric characteristics, constantly affords pictures with a high resolving degree, prevents the formation of toner films on the surfaces of the carrier particles and of the photoelectric conductor, suppresses the confusion of pictures at the remixation of the recovered toner, reduces wear and tear of the developing machine and improves the workability at the mixation of the carrier with the toner.

The said object can be attained by the use of a toner composition which comprises a toner in fine powder having an average particle size of 30 microns or less and silica powder whose surface is coated with the same base resin as in the toner.

According to the invention, there is provided a toner composition for electrostatic photography which comprises (A) toner powder comprising a base resin and a coloring agent and having an average particle size of not more than 30 microns and (B) silica powder coated with the base resin at the surface.

The toner powder to be used as the component (A) may be any conventional one, for example, a toner powder comprising as the base resin polystyrene, a copolymer of styrene with an acrylate and/or a methacrylate, an epoxy resin, a polyacrylate, a polyamide resin, a polyester resin, a polyvinyl chloride, a copolymer of vinyl chloride with vinyl acetate or the like and as the additives a coloring agent (e.g. carbon black, various organic dyes) and an electrification-regulating agent (an antistatic agent) (e.g. nigrosine base, nigrosine base salt, Neutral Red, Nile Blue). In case of the average particle size being larger than 30 microns, the resolving power of the copied picture is reduced, and fogging due to rough powder is caused so that a clear picture is not obtainable.

For attaining an electrostatic photography with an excellent resolving power and a high reflection concentration at the solid portion as well as a small toner layer thickness even in a heat roll fixing method suitable for high speed copying, the use of a toner powder comprising (a) a styrene resin having a weight average molecular weight of not less than 3,000, (b) furnace type carbon black of pH 6.5 to 9.5, (c) low molecular weight polyolefin having a weight average molecular weight of not more than 10,000 and (d) an electrification-regulating agent in a weight proportion of 100:5–15:3–10:0.5–5 is particularly recommended. Such toner powder is favorable to have a particle size of 5 to 20 microns and an average particle size of 9 to 10 microns.

The styrene resin (a) may be the one conventionally employed as a toner resin and having a weight average molecular weight of 3,000 or more, preferably of 3,000 to 100,000. Specific examples are polystyrene, a copolymer of styrene or its derivative (e.g. p-chlorostyrene, vinyltoluene) with any other vinyl monomer (e.g. ethylene, vinyl chloride, butadiene, methyl acrylate, butyl methacrylate, acrylonitrile, acrylamide, vinyl methyl ether, vinyl methyl ketone, N-vinylpyrrole), etc. These styrene resins may be used solely or in combination. As commercially available products of such styrene resin, there may be exemplified "Highmer SBM 600, SBM 73" (manufactured by Sanyo Chemical Industries Ltd.), "Priolite S-6B, VTL, VTACL, ACL, HML" (manufactured by Goodyear Tire Corp.), "Picolastic D-150, D-125" (manufactured by Esso Research & Engineering Co.), etc. When a styrene resin having a weight average molecular weight of smaller than 3,000 is used, the softening point is too low so that the storage stability is reduced and the "blocking phenomenon" is caused.

As the carbon black (b), there may be employed neutral or weakly basic furnace type carbon black of pH 6.5 to 9.5, preferably pH 7 to 8.5. Usually, this carbon black has a particle size of 10 to 25 mμ, preferably of 15 to 20 mμ. The tinting strength index showing the coloring ability of carbon black is desired to be 100 or more, preferably 115 or more. As commercially available products of such carbon black, there may be exemplified "Monarch 700, 800, 880, 900" and "Black Pearls 700, 800, 880, 900" (manufactured by Cabot), "RAVEN 1170, 1250" (manufactured by Columbian Carbon Japan Ltd.), etc. These products may be used solely or in combination. The carbon black is usually used in an amount of 5 to 15 parts, preferably 5 to 10 parts, to 100 parts of the component (a). When the amount is smaller than 5 parts, the reflection concentration of toner particles is lowered. When the amount is larger than 15 parts, the layer thickness of the toner image becomes insufficient, and the reflection concentration is lowered. The acidity (basicity) of the carbon black has a large influence upon the density of the toner image. When the pH is smaller than 6.5, fine gaps are readily formed on the toner image layer, and the toner layer thickness becomes large. When the pH is larger than 9.5, the layer thickness of the toner image becomes too small, and a sufficient reflection concentration at the solid portion can not be obtained.

The low molecular weight polyolefin (c) may be low molecular weight polyethylene or polypropylene conventionally used as an additive for toner powder in the heat roll fixing method and having a weight average molecular weight of 10,000 or less, preferably of 2,000 to 8,000. As commercially available products of such low molecular weight polyolefin, there may be exemplified "AC Polyethylene 6A, 617" (manufactured by Allied Chemical Corp.), "Biscole 550P" (manufactured by Sanyo Chemical Industries Ltd.), etc. These products may be used solely or in combination. The amount of the low molecular weight polyolefin to be used may be from 3 to 10 parts, preferably from 3 to 5 parts, to 100 parts of the component (a) from the viewpoint of endowment of the releasing property and improvement of the fluidity. When low molecular weight polyolefin having a weight average molecular weight of larger than 10,000 is used, the softening point is high so that the offset phenomenon can not be prevented.

As the electrification-regulating agent (d), there may be employed conventional ones such as nigrosine dyes and metal-containing dyes. Examples of commercially available products of such electrification-regulating agent are "Bontron N-01, N-02, N-03, S-31" (manufactured by Orient Chemical), etc. These products may be used solely or in combination. The amount of the electrification-regulating agent to be used may be from 0.5 to 5 parts, preferably from 0.5 to 2 parts, to 100 parts of the component (a). When the amount is smaller than 0.5 part, the amount of charged electricity is too small so that powdery smoke is generated at development, and fogging is formed on copied paper. When the amount is larger than 5 parts, the amount of charged electricity is too large, and the reflection concentration at the solid portion is lowered.

The toner powder may be prepared by mixing the components (a) to (d) in the said proportion by a conventional procedure. For example, the components (a) to (d) are mixed preliminarily, and the obtained mixture is subjected to melt-kneading by the aid of a heat roll or an extruder, rough crushing by a hammer mill, fine crushing by a jet mill and classifying by a zigzag classifier. The thus obtained toner powder is preferred to have a particle size of 5 to 20 microns and an average particle size of 9 to 10 microns. When the lower limit of the particle size is smaller than 5 microns, the durability of the toner powder is reduced, and contamination is increased. Besides, the powder fluidity is lowered to deteriorate the developing property and to prevent smooth supply of the toner powder. When the upper limit of the particle size is larger than 20 microns, the density of the toner image becomes small to form gaps in the layer and to enlarge the layer thickness. By such enlargement of the layer thickness, the thermal conduction is not effected smoothly in case of high speed copying, which results in the offset phenomenon (cold offset) due to insufficiency of fixation. This phenomenon can be prevented by increasing the amount of the releasing agent, for instance, to 15 to 20% by weight to the toner resin, but in such case, the powder fluidity is lowered to exert bad influences upon the developing property and the supply of toner powder. Still, the toner powder thus obtained shows an adequate fluidity with an angle of repose of about 43° to 45°.

The surface-coated silica powder to be used as the component (B) is obtainable by coating the surfaces of particles of silica with the base resin in the toner powder. Such base resin has usually a softening point of 50° to 130° C., preferably of 70° to 120° C.

As the starting uncoated silica, there may be used any conventional silica such as the so-called "dry method silica" obtained by hydrolysis of silicon tetraoxide in oxyhydrogen flame or the so-called "hydrophobic silica" obtained by etherifying at least 75% of the hydroxyl groups present on the surfaces of the particles of the dry method silica with hydrophobic organic groups.

The coating may be carried out, for example, by dispersing the starting silica in a solution of the base resin in a suitable solvent and subjecting the resultant dispersion to drying, followed by granulating and sieving. As to the mixing proportion of the starting silica and the base resin, there is no particular limitation. Usually, 1 to 10 parts (by weight), preferably 2 to 5 parts, of the base resin are used to 100 parts of the starting silica. In case of the proportion of the base resin being smaller than the lower limit, the deterioration of picture quality may be caused when the recovered toner is used. In case of the proportion being larger than the upper limit, the toner film formation on the surfaces of the carrier and the photoelectric conductor is not sufficiently prevented.

The particle size of the surface-coated silica is desired to be 5 microns or less, preferably 1 micron or less. With a particle size larger than 5 microns, a sufficient effect by the use of silica is not expected. For example, the number of particles of the silica powder held by one particle of the toner powder is decreased so that the characteristics are lowered and the prevention of the toner film formation on the surfaces of the carrier and the photoelectric conductor is reduced.

The toner composition of the invention comprises as the essential components the toner powder and the surface-coated silica powder. The mixing proportion of these essential components may be optionally decided. Usually, the amount of the surface-coated silica powder may be in the range of 0.1 to 1% (by weight), preferably 0.2 to 0.8%, on the basis of the total weight of the toner composition. When the amount is smaller than 0.1%, the effect for prevention of the toner film formation on the carrier or the photoelectric conductor surface is lowered. When the amount is larger than 1%, the picture impairment due e.g. to picture fogging, decrease of resolving power and lowering of concentration is readily caused in case of resupplying the undeveloped toner as recovered to the developing machine continuously, and at the same time, wear and tear of the developing machine is accelerated.

The preparation of the toner composition may be carried out, for example, by mixing the essential components in a conventional mixing machine (e.g. Henschel mixer) at room temperature for a certain period of time (for instance, 5 to 10 minutes in case of Henschel mixer).

The toner composition of the invention possesses excellent powder fluidity and electric charge stability as in a conventional toner composition comprising toner powder and uncoated-silica powder. In addition, the toner film formation on the carrier or the photoelectric conductor can be efficiently prevented, and the progress of deterioration is extremely delayed even in case of a large number of times of copying. In the conventional toner composition containing uncoated-silica powder, scattering of the toner composition is caused at mixing with the carrier to contaminate the inside of the copying machine, and wear and tear of the developing machine becomes marked to greatly shorten the life of the machine. In the toner composition of the invention, mixing thereof with the carrier can be accomplished with ease, and wear and tear of the developing machine is reduced. A noteworthy advantage of the toner composition of the invention is that, even in case of resupplying the undeveloped toner as recovered to the developing machine continuously, disorder of picture, lowering of picture concentration, etc. are not produced.

The present invention will be hereinafter explained further in detail by the following Examples in which Comparative Examples are also shown. In these Examples and Comparative Examples, part(s) and % are by weight, unless otherwise indicated.

EXAMPLE 1

Preparation of surface-coated silica powder

To a resin solution obtained by dissolving a polystyrene resin ("Picolastic D-125" manufactured by Esso Research & Engineering Co.) (5 parts) into acetone (100 parts) and toluene (2900 parts), dry method silica powder ("Aerosil 200" manufactured by Degussa) (100 parts) is added, and the mixture is stirred for about 30 minutes by the aid of a high speed stirrer to obtain a dispersion, which is subjected to spray drying, granulating and sieving to obtain surface-coated silica powder having a particle size of 5 microns or less.

Preparation of toner composition

To toner powder (100 parts) having an average particle size of 12 microns and comprising the above mentioned "Picolastic D-125" as the base resin and carbon black, a metal-containing dye and low molecular weight polyethylene as the additives, the above obtained surface-coated silica powder (0.5 part) is added, and the mixture is kneaded uniformly by the aid of a Henschel mixer to obtain a toner composition.

Copying test

To surface-oxidized iron powder ("EFV-III" manufactured by Nihon Teppun K.K.) (1000 parts) as the carrier, the toner composition (30 parts) is added, and the mixture is kneaded uniformly to make a developing agent, which is used in the copying test.

A copying machine having an amorphous selenium drum as the photoelectric conductor is remodelled so that the recovered toner composition after drum cleaning is automatically circulated into the toner-supplying part, and the thus remodelled apparatus is used for copying.

Copying is repeated continuously to obtain 30000 sheets of copied paper. The picture obtained by the use of the toner composition shows a lower background concentration and a better resolving degree and is superior in concentration of image-formed portions and in clearness of border portions, compared with the pictures obtained by the use of the said toner powder itself (Comparative Example 1) and by the use of a mixture of the toner powder (100 parts) with hydrophobic silica powder ("Aerosil R 972" manufactured by Degussa) (0.5 part) (Comparative Example 2). The detailed results of comparison are shown in Table 1.

TABLE 1

| Toner composition | | Present invention | Comparative Example 1 | Comparative Example 2 |
|---|---|---|---|---|
| Thermal stability (45° C.) | | ◎ | x | ◎ |
| Moisture stability (20°C., 80%) | | ◎ | Δ | ◎ |
| Miscibility of toner with carrier | | ◎ | ◎ | x |
| Initial picture | Background concentration | ◎ | ◎ | ◎ |
| | Resolving degree | ◎ | ◎ | ◎ |
| | Concentration of image-formed portion | ◎ | ◎ | ◎ |
| | Clearness of border portion | ◎ | ◎ | ◎ |
| Copied picture after 30000 times of copying | Background concentration | ○ | x (fogging being caused after 10000 times of copying) | Δ (fogging being caused after 12000 times of copying) |
| | Resolving degree | | x (reduced after 12000 times of copying) | Δ (reduced after 20000 times of copying) |
| | Concentration of imag-formed por- | | x (reduced after 10000 times of | Δ (reduced after 12000 times of |

TABLE 1-continued

| Toner composition | | Present invention | Comparative Example 1 | Comparative Example 2 |
|---|---|---|---|---|
| | tion | | copying) | copying) |
| | Clearness of border portion | ⊙ | x (reduced after 12000 times of copying) | Δ (reduced after 20000 times of copying) |
| Scattering of toner inside copying apparatus | | Little | Little | Much |
| Wear and tear of rotating part of developing machine | | None | None | Observed on whole surface |

EXAMPLE 2

Preparation of surface-coated silica powder

To a resin solution obtained by dissolving the "Picolastic D-125" used in Example 1 (2 parts) into acetone (100 parts) and toluene (2900 parts), hydrophobic silica powder ("Aerosil R 972") (100 parts) and vinyltris(β-methoxyethoxy)silane ("KBC-1003" manufactured by Shinetsu Chemical Industry Co., Ltd.) (0.01 part) are added, and the mixture is stirred for about 30 minutes by the aid of a high speed stirrer to obtain a dispersion, which is subjected to spray dyring, granulating and sieving to obtain surface-coated silica powder having a particle size of 5 microns or less.

Preparation of toner composition

To the same toner powder having an average particle size of 12 microns as used in Example 1 (100 parts), the above obtained surface-coated silica powder (0.8 part) is added, and the mixture is kneaded uniformly by the aid of a Henschel mixer to obtain a toner composition.

Copying test

In the same manner as in Example 1, a developing agent is prepared, and continuous copying is carried out to obtain 3000 sheets of copied paper. As understood from the test results shown in Table 2, the use of the toner composition affords an extremely excellent effect in comparison with Comparative Examples 1 and 2.

TABLE 2

| Toner composition | | Present invention | Comparative Example 1 | Comparative Example 2 |
|---|---|---|---|---|
| Theremal stability (45° C.) | | ⊙ | x | ⊙ |
| Moisture stability (20° C., 80%) | | ⊙ | Δ | ⊙ |
| Miscibility of toner with carrier | | ⊙ | ⊙ | x |
| Initial picture | Background concentration | ⊙ | ⊙ | ⊙ |
| | Resolving degree | ⊙ | ⊙ | ⊙ |
| | Concentration of image-formed portion | ⊙ | ⊙ | ⊙ |
| | Clearness of border portion | ⊙ | ⊙ | ⊙ |
| Copied picture after 30000 times of copying | Background concentration | ○ | x (fogging being caused after 10000 times of copying) | Δ (fogging being caused after 12000 times of copying) |
| | Resolving degree | ⊙ | x (reduced after 12000 times of copying) | Δ (reduced after 20000 times of copying) |
| | Concentration of image-formed portion | ○ | x (reduced after 10000 times of copying) | Δ (reduced after 12000 times of copying) |
| | Clearness of border portion | ⊙ | x (reduced after 10000 times of copying) | Δ (reduced after 20000 times of copying) |
| Scattering of toner inside copying apparatus | | Little | Little | Much |
| Wear and tear of rotating part of developing machine | | None | None | Observed on whole surface |

EXAMPLE 3

Preparation of surface-coated silica powder

To a resin solution obtained by dissolving a styreneacryl copolymer resin ("Highmer SBM 600" manufactured by Sanyo Chemical Industries Ltd.; $\overline{M}w$, 6000) (5 parts) into acetone (100 parts) and toluene (2900 parts), dry method silica powder (100 parts) is added, and the mixture is stirred for about 30 minutes by the aid of a high speed stirrer to obtain a dispersion, which is subjected to spray drying, granulating and sieving to obtain surface-coated silica powder having a particle size of 5 microns or less.

Preparation of toner composition

"Highmer SBM 600" (100 parts), low molecular weight polypropylene ("Biscole 550P" manufactured by Sanyo Chemical Industries Ltd.; $\overline{M}w$, 4000) (5 parts), carbon black ("RAVEN 1250" manufactured by Columbian Carbon Japan Ltd.; pH, 7.0) (8 parts) and an electrification-regulating agent ("Bontron S-31" manufactured by Orient Chemical) (2 parts) are mixed preliminarily by the aid of a mixer and then melt-kneaded by a heat roll. The resultant mixture is subjected to rough crushing, fine crushing and sieving to obtain a toner powder having a particle size of 5 to 20 microns with an average particle size of 9 to 10 microns. The angle of repose of the thus obtained toner powder is 43° (determined by the aid of "Powder Tester" manufactured by Hosokawa Tekko).

To the toner powder (100 parts) as above prepared, the previously obtained surface-coated silica powder (0.5 part) is added, and the mixture is kneaded uniformly by the aid of a henschel mixer to obtain a toner composition.

The toner composition as above obtained may be used in the same manner as in Example 1.

EXAMPLES 4 TO 9

In the same manner as in Example 1 but using a toner powder prepared from the components as shown in Table 3, there is obtained a toner composition:

TABLE 3

| | Example | 4 | 5 | 6 | 7 | 8 | 9 |
|---|---|---|---|---|---|---|---|
| Component (part(s)) | Picolastic D-150*1 | 100 | 100 | 50 | 100 | — | — |
| | Picolastic | — | — | 50 | — | — | — |

TABLE 3-continued

| Example | 4 | 5 | 6 | 7 | 8 | 9 |
|---|---|---|---|---|---|---|
| D-125*2 | | | | | | |
| Highmer SBM 600 | — | — | — | — | 100 | 100 |
| Biscole 550P | 5 | 3 | — | — | 5 | 5 |
| AC Polyethylene 6A*3 | — | — | 5 | — | — | — |
| AC Polyethylene 617*4 | — | — | — | 5 | — | — |
| Monarch 880*5 | 8 | 8 | 8 | — | — | — |
| RAVEN 1250 | — | — | — | 8 | 8 | 8 |
| Bontron S-31 | 2 | 2 | 2 | 2 | 1 | 3 |
| Angle of repose | 44° | 43° | 44° | 44° | 43° | 45° |

Note:

*1Polystyrene resin manufactured by Esso Research & Engineering Co., $\overline{M}w$, about 5000;

*2Polystyrene resin manufactured by Esso Research & Engineering Co., $\overline{M}w$, about 3000;

*3Low molecular weight polyethylene manufactured by Allied Chemical Corp.;

*4Low molecular weight polyethylene manufactured by Allied Chemical Corp.;

*5Carbon black manufactured by Cabot, pH, 8.0.

EXAMPLES 10 AND 11

In the same manner as in Example 1 but using a toner powder prepared from the components as shown in Table 4, there is obtained a toner composition:

TABLE 4

| | Example | 10 | 11 |
|---|---|---|---|
| Component (part(s)) | Priolite VTL*1 | 100 | 100 |
| | AC Polyethylene 6A*2 | 5 | — |
| | Biscole 500* | — | 5 |
| | Monarch 880*3 | 8 | 8 |
| | Bontron N-02*4 | 1.5 | — |
| | Bontron N-01*5 | — | 2 |

TABLE 4-continued

| Example | 10 | 11 |
|---|---|---|
| Angle of repose | 43° | 44° |

Note:

*1Vinyltoluene-butadiene coploymer resin manufactured by Goodyear, $\overline{M}w$, 78000;

*2Low molecular weight polyethylene manufactured by Allied Chemical Corp.;

*3Carbon black manufactured by Cabot, pH, 8.0;

*4Electrification-regulating agent manufactured by Orient Kagaku;

*5Electrification-regulating agent manufactured by Orient Kagaku.

What is claimed is:

1. A toner composition for electrostatic photography which comprises (A) toner powder comprising a base resin and a coloring agent and having an average particle size of not more than 30 microns and (B) silica powder coated on its surface with the base resin of the toner powder.

2. The toner composition according to claim 1, wherein the toner powder (A) comprises (a) a styrene resin having a weight average molecular weight of not less than 3,000, (b) furnace type carbon black of pH 6.5 to 9.5, (c) low molecular weight polyolefin having a weight average molecular weight of not more than 10,000 and (d) an electrification-regulating agent in a weight proportion of 100:5–14 15:3–10:0.5–5.

3. The toner composition according to claim 1 or 2, wherein the content of the surface-coated silica powder (B) is 0.1 to 1% by weight on the total weight of the toner composition.

4. The toner composition according to any of claims 1 to 3, wherein the surface-coated silica powder (B) comprises silica powder and the base resin coated on the surface of the silica powder in a weight proportion of 100:1–10.

5. The toner composition according to any of claims 1 to 4, wherein the surface-coated silica powder has a particle size of not more than 5 microns.

6. The toner composition according to any of claims 1 to 5, which is usable for the heat roll fixation method.

7. The toner composition according to any of claims 2 to 6, wherein the low molecular weight polyolefin is low molecular weight polyethylene or low molecular weight polypropylene.

8. The toner composition according to any of claims 2 to 7, wherein the electrification-regulating agent is a nigrosine dye or a metal containing dye.

* * * * *